US007917073B2

(12) United States Patent
Miyata et al.

(10) Patent No.: US 7,917,073 B2
(45) Date of Patent: Mar. 29, 2011

(54) SLIDING MEMBER AND FIXING DEVICE, AND IMAGE FORMING APPARATUS USING THE SAME

(75) Inventors: Toshiyuki Miyata, Kanagawa (JP); Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 421 days.

(21) Appl. No.: 12/050,689

(22) Filed: Mar. 18, 2008

(65) Prior Publication Data

US 2009/0080954 A1 Mar. 26, 2009

(30) Foreign Application Priority Data

Sep. 20, 2007 (JP) ..... 2007-244301

(51) Int. Cl.
*G03G 15/20* (2006.01)

(52) U.S. Cl. ..... 399/329

(58) Field of Classification Search ..... 399/320, 399/329, 330

See application file for complete search history.

(56) References Cited

U.S. PATENT DOCUMENTS

| | | | | |
|---|---|---|---|---|
| 5,705,272 | A * | 1/1998 | Taniguchi | 428/408 |
| 6,456,819 | B1 * | 9/2002 | Abe et al. | 399/329 |
| 2006/0083567 | A1 * | 4/2006 | Ito et al. | 399/400 |
| 2006/0269334 | A1 * | 11/2006 | Takahashi | 399/329 |

FOREIGN PATENT DOCUMENTS

| | | | |
|---|---|---|---|
| CN | 1100252 | A | 3/1995 |
| EP | 0632 344 | A2 | 1/1995 |
| JP | 7-295409 | | 11/1995 |
| JP | 3829695 | B | 7/2006 |

* cited by examiner

*Primary Examiner* — David M Gray
*Assistant Examiner* — Rodney Bonnette
(74) *Attorney, Agent, or Firm* — Morgan, Lewis & Bockius LLP

(57) ABSTRACT

A fixing device includes a fixing belt, a pressure member that contacts the outer peripheral surface of the fixing belt, and at least one fixed sliding member on which the fixing belt slides. The fixed sliding member contacts the inner peripheral surface of the fixing belt. At least one of the fixing belt and the fixed sliding member includes a non-continuous diamond-like carbon layer on a sliding surface between the fixing belt and the fixed sliding member. The non-continuous diamond-like carbon layer is formed from a plurality of diamond-like carbon layer portions that are separated from one another by grooves.

16 Claims, 7 Drawing Sheets

SLIDING MEMBER AND FIXING DEVICE, AND IMAGE FORMING APPARATUS USING THE SAME

CROSS-REFERENCE TO RELATED APPLICATION

This application claims priority under 35 USC 119 from Japanese Patent Application No. 2007-244301 filed on Sep. 20, 2007.

BACKGROUND OF THE INVENTION

1. Field of the Invention

The present invention relates to a sliding member and a fixing device, and an image forming apparatus using the sliding member or the fixing device.

2. Description of the Related Art

Various fixing devices have been proposed recently that use a belt, instead of conventional fixing devices that use rolls, with the aim of achieving high manufacturability and increasing the ease-of-use by shortening the warm up time of heating members and the like.

SUMMARY OF THE INVENTION

The present invention provides a sliding member that may effectively prevent cracking and delamination of a diamond-like carbon layer.

Further provided is a fixing device that may maintain superior abrasion resistance and sliding properties over a prolonged period of time, and an image forming apparatus that may provide superior images over a prolonged period of time.

According to a first exemplary embodiment of a first aspect of the invention, there is provided a sliding member comprising:

a substrate; and a non-continuous diamond-like carbon layer provided on a surface of the substrate, the non-continuous diamond-like carbon layer being formed from a plurality of diamond-like carbon layer portions that are separated from one another by grooves.

According to a first exemplary embodiment of a second aspect of the invention, there is provided a fixing device comprising:

a fixing belt;

a pressure member that contacts the outer peripheral surface of the fixing belt; and at least one fixed sliding member on which the fixing belt slides, the fixed sliding member contacting the inner peripheral surface of the fixing belt, at least one of the fixing belt and the fixed sliding member comprising a non-continuous diamond-like carbon layer on a sliding surface between the fixing belt and the fixed sliding member, the non-continuous diamond-like carbon layer being formed from a plurality of diamond-like carbon layer portions that are separated from one another by grooves.

According to a first exemplary embodiment of a third aspect of the invention, there is provided an image forming apparatus, comprising a sliding member including: a substrate; and a non-continuous diamond-like carbon layer provided on a surface of the substrate, the non-continuous diamond-like carbon layer being formed from a plurality of diamond-like carbon layer portions that are separated from one another by grooves.

According to a first exemplary embodiment of a fourth aspect of the invention, there is provided an image forming apparatus comprising a fixing device including:

a fixing belt;

a pressure member that contacts the outer peripheral surface of the fixing belt; and at least one fixed sliding member on which the fixing belt slides, the fixed sliding member contacting the inner peripheral surface of the fixing belt, at least one of the fixing belt and the fixed sliding member comprising a non-continuous diamond-like carbon layer on a sliding surface between the fixing belt and the fixed sliding member, the non-continuous diamond-like carbon layer being formed from a plurality of diamond-like carbon layer portions that are separated from one another by grooves.

BRIEF DESCRIPTION OF THE DRAWINGS

Exemplary embodiments of the present invention will be described in detail based on the following figures, wherein.

DETAILED DESCRIPTION OF THE INVENTION

Figure 1:
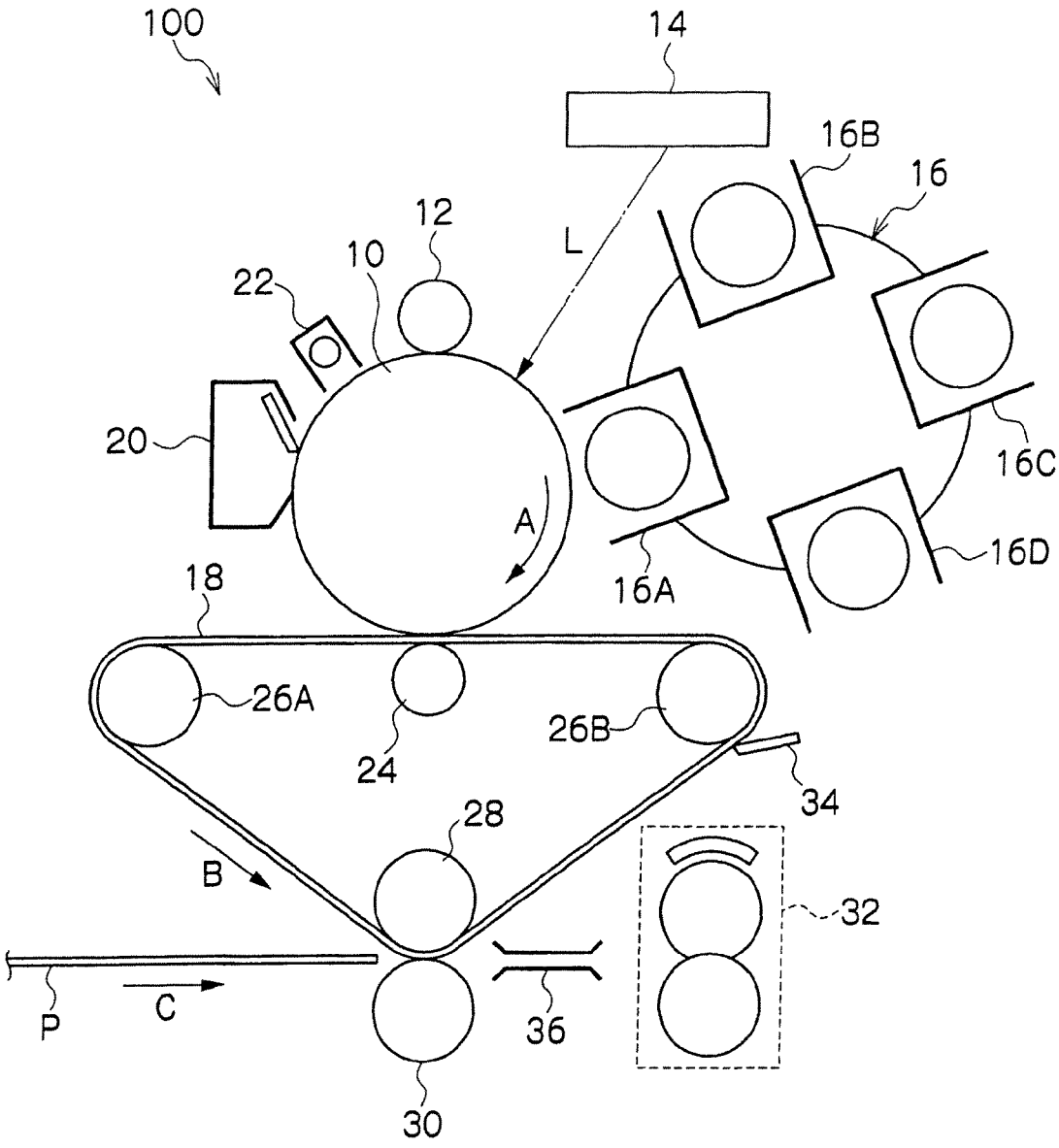
FIG. 1 is a schematic configuration diagram showing an image forming apparatus according to a first exemplary embodiment of the invention.

The invention provides a sliding member, including:

a substrate; and a non-continuous diamond-like carbon layer provided on a surface of the substrate, the non-continuous diamond-like carbon layer being formed from a plurality of diamond-like carbon layer portions that are separated from one another by grooves.

Specific examples of the sliding member include a belt for image formation, a fixing belt, and a fixed sliding member for an image forming apparatus.

Explanation will now be given of exemplary embodiments of the present invention with reference to the drawings. It should be noted that members with the same function are appended with the same reference numerals throughout the drawings, and duplicated explanation thereof may be omitted.

First Exemplary Embodiment

Figure 2:
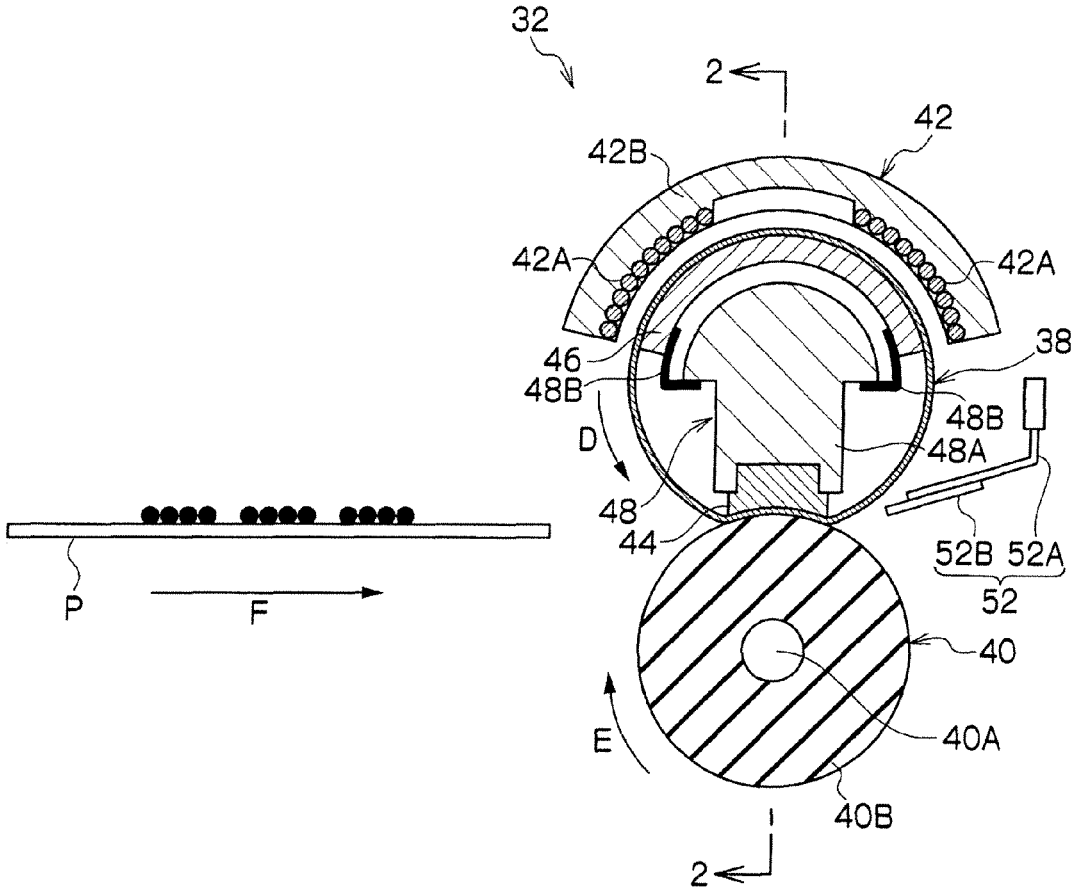
FIG. 2 is a schematic cross-section showing a fixing device according to the first exemplary embodiment.
Figure 3:
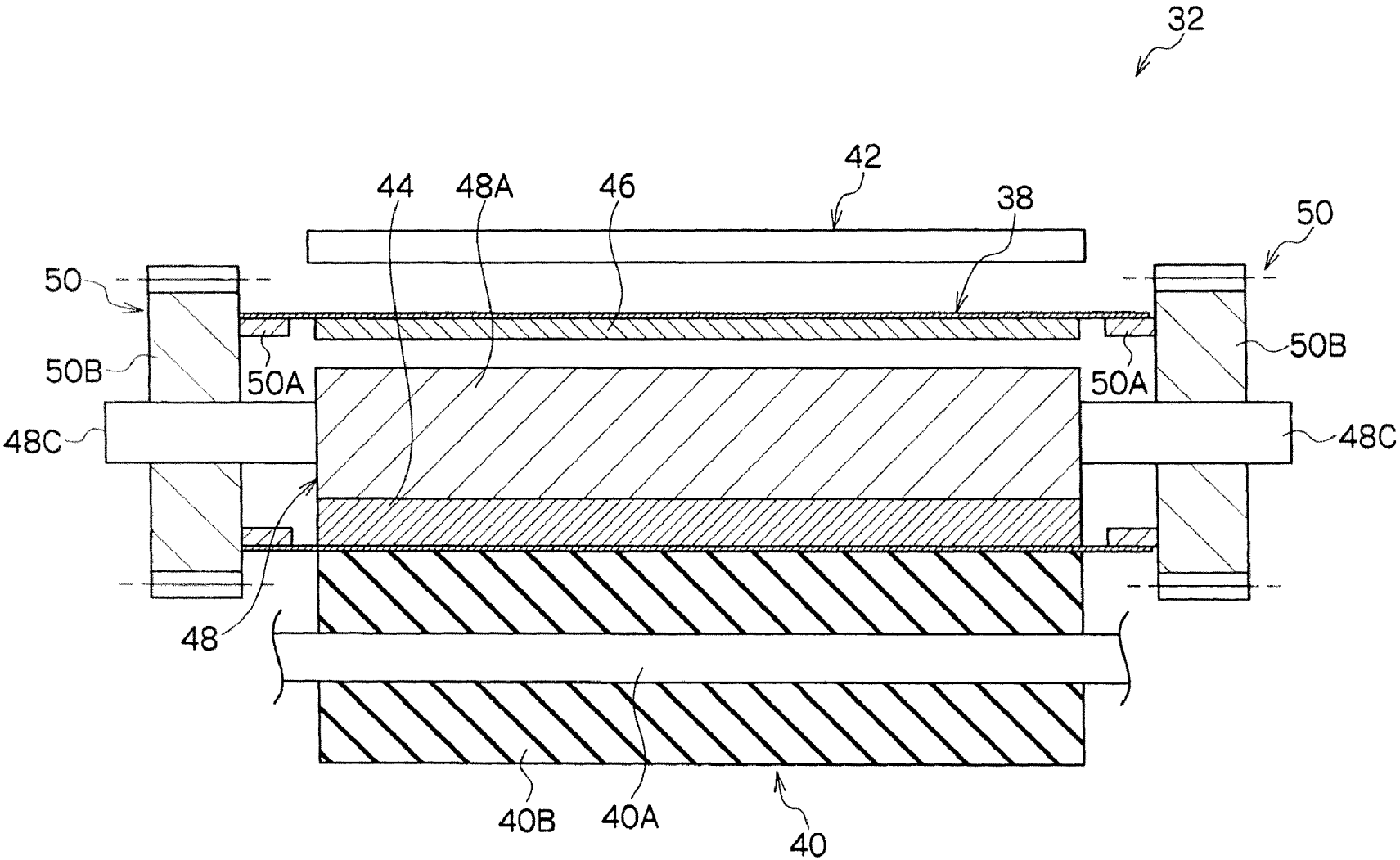
FIG. 3 is a different schematic cross-section showing a fixing device according to the first exemplary embodiment.
Figure 4A:
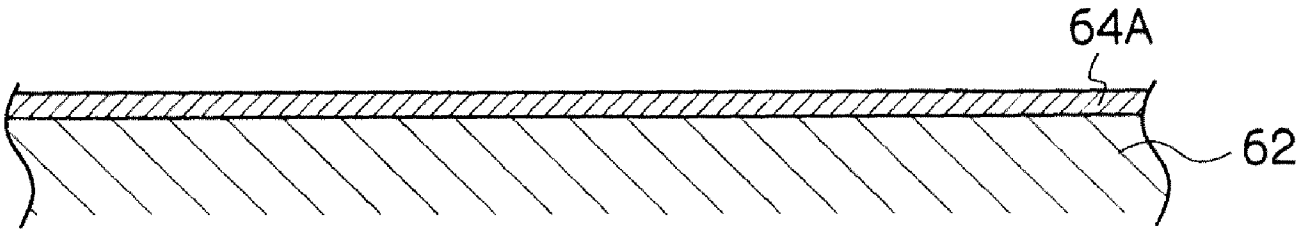
FIG. 4A is a schematic cross-section showing the surface of a fixing belt using conventional technology.
Figure 4B:
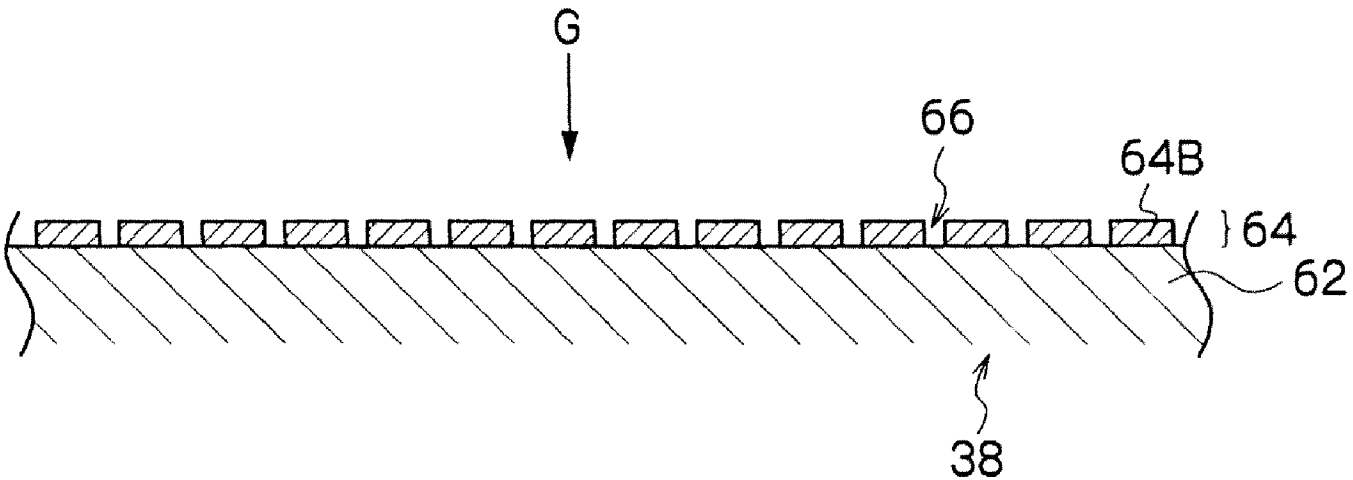
FIG. 4B is a schematic cross-section showing the surface of a fixing belt of the first exemplary embodiment.
Figure 5:
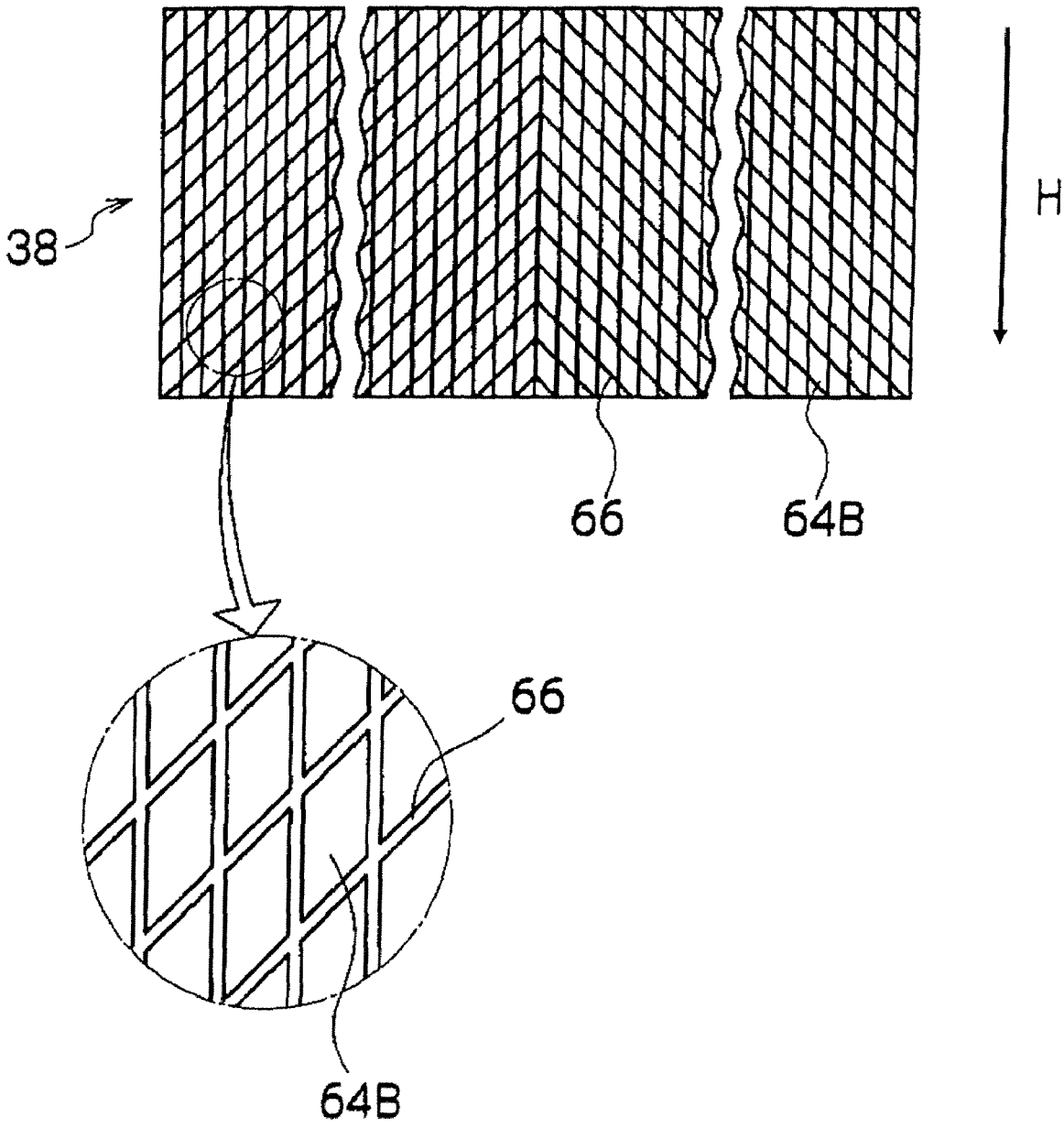
FIG. 5 is a schematic plan view showing a fixing belt according to the first exemplary embodiment.

FIG. 1 is a schematic configuration diagram showing an image forming apparatus according to a first exemplary embodiment of the invention. FIG. 2 is a schematic cross-section showing a fixing device according to the first exemplary embodiment. FIG. 3 is a different schematic cross-section showing a fixing device according to the first exemplary embodiment. FIG. 4A is a schematic cross-section showing the surface of a fixing belt with conventional technology. FIG. 4B is a schematic cross-section showing the surface of a fixing belt which is a sliding member of the first exemplary embodiment. FIG. 5 is a schematic plan view showing a fixing belt according to the first exemplary embodiment.

A schematic cross-section of the fixing device is shown in FIG. 2, looking along the axial direction of the fixing device. FIG. 3 is a schematic cross-section of a fixing device, and is a schematic cross-section taken on 2-2 of FIG. 2 shown looking along a direction that is orthogonal to the axial direction of the fixing device. FIG. 4A and FIG. 4B are schematic cross-sections of fixing belts showing surface profiles thereof. FIG. 5 is a schematic plan view of a fixing belt seen from the direction of arrow G in FIG. 4B (the inner peripheral surface of the fixing belt seen from a direction that is orthogonal to the fixing belt axial direction).

An image forming apparatus 100 according to the first exemplary embodiment, as shown in FIG. 1, is provided with a circular cylinder-shaped photoreceptor drum 10 that rotates in one direction (shown as the direction of arrow A in FIG. 1). Around the periphery of the photoreceptor drum 10 there are provided, in sequence from the upstream side in the rotation direction of the photoreceptor drum 10: a charging device 12 for charging the surface of the photoreceptor drum 10; an exposure device 14 for irradiating image light L onto the photoreceptor drum 10 to form latent images on the surface of the photoreceptor drum 10; a developing device 16 including developers 16A to 16D for selectively transferring toner onto the latent images on the photoreceptor drum 10 surface to form toner images; an intermediate transfer member 18 that is of an endless belt shape, supported so as to face the photoreceptor drum 10 and so that the peripheral surface of the intermediate transfer member 18 is able to rotate; a cleaning device 20 for removing any toner remaining on the photoreceptor drum 10 after the toner images have been transferred onto the intermediate transfer member 18; and a charge removing light exposing device 22 for removing remaining charge on the surface of the photoreceptor drum 10.

Furthermore, there are, disposed at the inside of the intermediate transfer member 18, a primary transfer device 24 for primary transferring the toner image that has been formed on the surface of the photoreceptor drum 10 to the intermediate transfer member 18, two support rolls 26A and 26B, and a transfer counter roll 28 for carrying out secondary transfer. The intermediate transfer member 18 is entrained around the primary transfer device 24, the support rolls 26A and 26B, and the transfer counter roll 28 so as to be able to rotate in one direction (shown as the direction of arrow B in FIG. 1). There is a transfer roll 30 provided facing the transfer counter roll 28 with the intermediate transfer member 18 therebetween, the transfer roll 30 carrying out secondary transfer of the toner images, which been primary transferred to the outer peripheral surface of the intermediate transfer member 18, onto a sheet of recording paper (a recording medium) P, with a press-contact portion between the transfer counter roll 28 and the transfer roll 30 such that the sheet of recording paper P is fed in, in the direction of arrow C. The toner image is secondary transferred onto the surface of the recording paper P at the press-contact portion and the recording paper P is conveyed in the direction of arrow C.

On the downstream side of the transfer roll 30 in a direction in which the sheet of recording paper P is conveyed (i.e., a direction of arrow C), there is provided a fixing device 32 for thermally fusing the toner image transferred onto the surface of the recording sheet of paper P to fix it on the recording sheet of paper P. The sheet of recording paper P having the toner image is fed into the fixing device 32 via a paper guide member 36. Around the intermediate transfer member 18, a cleaning device 34 for removing the toner remaining on the surface of the intermediate transfer member 18 is provided downstream in the rotation direction of the intermediate transfer member 18 (i.e., a direction of arrow B).

Explanation will now be given of a fixing device according to the first exemplary embodiment.

As shown in FIG. 2 and FIG. 3, a fixing device 32 according to the first exemplary embodiment is provided with: a fixing belt 38 that is of an endless belt shape and that rotates in one direction (the direction of arrow D); a pressure roll 40 that press contacts with the outer peripheral surface of the fixing belt 38 and that rotates in one direction (the direction of arrow E); and a magnetic field generation device 42 that is disposed facing, but at a distance from, the outer peripheral surface of the fixing belt 38 at the opposite side thereof to the side of the press-contact surface of the pressure roll 40.

At the inner peripheral side of the fixing belt 38 there are provided: a fixed sliding member 44 that forms a contact portion with the pressure roll 40; a heat generation control member 46 that is disposed facing the magnetic field generation device 42 with the fixing belt 38 therebetween, the heat generation control member 46 being disposed in contact with the inner peripheral surface of the fixing belt 38; and a support member 48 for supporting the fixed sliding member 44. The heat generation control member 46 is also supported by the support member 48. There are driving force transmission members 50 provided at the two edge portions of the fixing belt 38, for imparting rotational driving force to the fixing belt 38 for rotational driving the fixing belt.

There is also a separating member 52 provided to the downstream side in the recording paper P conveying direction (direction of arrow F) of the contact portion between the fixing belt 38 and the pressure roll 40. The separating member 52 is formed with a support portion 52A that is fixed and supported at one end thereof, and a separation sheet 52B that is supported by the support portion 52A. The leading edge of the separation sheet 52B is disposed so as to be in the vicinity of, or in contact with, the fixing belt 38.

Explanation will first be given of the fixing belt 38. The fixing belt 38 is provided with a belt substrate 62 and a non-continuous diamond-like carbon (DLC) layer 64 that is provided on the surface (inner peripheral surface) of the belt substrate 62, as shown in FIG. 4B.

The belt substrate 62 is a heat generation layer that generates heat under the action of a magnetic field (magnetic flux), and the belt substrate 62 may be formed from a material that readily allows a magnetic field (magnetic flux) to pass through and readily generates heat by the action of such a magnetic field, with a low heat capacity. Specific examples of the heat generation layer include, for example, heat generation layers that include a non-magnetic metal material and are of a thickness of equal to or about 1 μm to equal to or about 20 μm, with equal to or about 2 μm to equal to or about 15 μm being preferable. Examples of the non-magnetic metal material include, for example, metals such as copper, aluminum or silver.

The non-continuous DLC layer 64 of the invention is different from the continuous DLC layer 64A shown in FIG. 4A, and as shown in FIG. 4B, in the non-continuous DLC layer 64 of the invention there are plural DLC layer portions 64B formed in a non-continuous film on the surface of the belt substrate 62, so as to be separate from each other. The thickness of the non-continuous DLC layer 64 is, for example, equal to or about 0.01 μm to equal to or about 5 μm, with equal to or about 1 μm to equal to or about 5 μm being preferable.

Furthermore, the plural DLC layer portions 64B are separated from each other by grooves 66, and, as shown in FIG. 5, the grooves 66 are formed at an angle that is toward the belt axial direction central portion when facing from the downstream side back toward the upstream side in the sliding direction (direction of arrow H) relative to the fixed sliding member 44. In other words, in reference to FIG. 5, the grooves 66 are formed symmetrically from the belt axial direction central portion to the respective left and right sides of the belt, and the grooves 66 that are formed in the region to the right side of the belt axial direction central portion are formed slanting at an angle up to the left from the axial direction portion edge of the right side region, while the grooves 66 that are formed in the region to the left side of the belt axial direction central portion are formed slanting at an angle up to the right from the axial direction portion edge of the left side region.

It should be noted that the length of each side of the plural DLC layer portions 64B shown above (that is to say the length of each side when the plural DLC layer portions 64B that have been formed on the belt inner peripheral surface are viewed from the belt radial direction) is formed to be equal to or about 10 μm to equal to or about 3 mm, with equal to or about 10 μm to equal to or about 100 μm being preferable. Furthermore, the width of the grooves 66 is formed to be equal to or about 1 μm to equal to or about 100 μm, with equal to or about 1 μm to equal to or about 10 μm being preferable.

Explanation will now be given of the diamond-like carbon (DLC) used in the plural DLC layer portions 64B. The structure and other properties relating to materials formed from carbon atoms, that is diamond, DLC, and graphite, are shown in Table 1. DLC is a material formed from carbon atoms, and is composed of an amorphous structure including both diamond structures and graphite structures, with partial hydrogenation thereof (part of which including bonds with hydrogen atoms). DLC therefore possesses properties that are intermediate to those of diamond and graphite.

Furthermore, a ta-C (Tetrahedral Amorphous Carbon) form of DLC is particularly preferably used from the standpoint of its high hardness and low abrasion coefficient. ta-C refers to a material formed from carbon atoms with an amorphous structure, wherein equal to or about 85% or more of bonding within the structure is sp3 bonding.

Table 1

TABLE 1

| | DIAMOND | DLC (Diamond Like Carbon) | GRAPHITE |
|---|---|---|---|
| STRUCTURE | 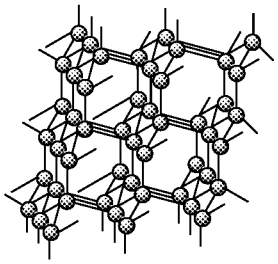 Crystalline ($sp^3$ Bondings) | 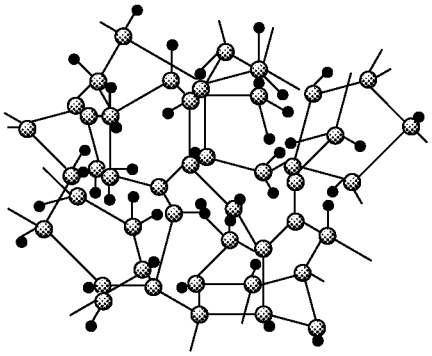 Amorphous ($sp^3$ and $sp^2$ Bondings) | 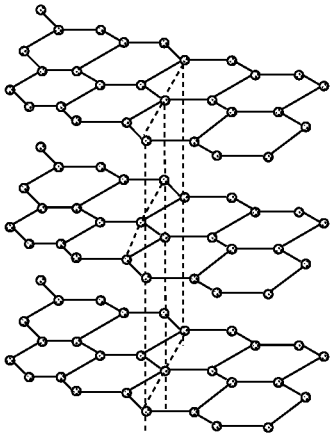 Crystalline ($sp^2$ Bondings) |
| CONSTITUTIVE ELEMENT | C | C•H | C |
| PROCESS | Plasma-Assisted Chemical Vapor Deposition(CVD) (Nonequilibrium Plasma) | Plasma-Assisted CVD Ion Plating etc. (Nonequilibrium Plasma) | CVD (Equilibrium Plasma) |
| REACTIVE GAS | CnHm and $H_2$ | CnHm or C Vapor | CnHm |
| | $CH_4$:$H_2$ = 1:100 | $CH_4$, $C_2H_2$, $C_6H_6$, etc. | CnHm |
| PROCESSING TEMPERATURE | ~700° C. | RT~300° C. | >1500° C. |

There are no particular limitations to the method of forming the plural DLC layer portions 64B, but they may be formed, for example, by a plasma-chemical vapor deposition method or by a cathodic arc method. The thickness of the plural DLC layer portions 64B is preferably equal to or about 0.5 μm to equal to or about 5 μm.

A ta-C layer may be formed as the plural DLC layer portions 64B by, for example, extracting $C^+$ from carbon (graphite) using electric arc discharge, and forming a film. Such a method is referred to as a cathodic arc method, and DLC layers with particular characteristics that have been formed by such methods are described, for example, in the publication International Conference on Micromechatronics for Information and Precision Equipment (Tokyo, Jul. 20-23, 1997) pp. 357 to 362. Such DLC layers have a relatively large number of sp3 bonds in comparison to DLC layers formed as films using reactive sputtering methods, Electron Cyclotron Resonance—Chemical Vapor Deposition (ECR-CVD) methods, and the like, and such DLC layers have the properties of hardness and a low abrasion coefficient, when used as coating materials.

Masking of the belt substrate 62 with predetermined shapes, in advance of application of the DLC, may be included in the method for forming the plural DLC layer portions 64B. In such a method the shape of the plural DLC layer portions 64B in the non-continuous DLC layer 64 may be freely designed.

The configuration of the fixing belt 38 is not limited to the configuration described above, and belts may be used in which, as a belt substrate 62, a heat generation layer is provided on the surface of a substrate layer, with a DLC layer formed on the inner peripheral surface thereof (surface of the substrate layer), and belts may be used that have a heat generation layer provided on such a substrate layer, but with an elastic layer therebetween.

It should be noted that the substrate layer is preferably formed from a material selected from materials which are strong enough for supporting the heat generation layer, are heat-resistant, and do not generate heat, or hardly generate heat, due to the action of a magnetic field while allowing the magnetic field to pass therethrough. For example, a metal belt may be used that is formed of a metal material, such as non-magnetic metals such as non-magnetic stainless-steel, soft magnetic materials and hard magnetic materials such as Fe, Ni, Co, or alloys thereof (such as Fe—Ni—Co alloys and Fe—Cr—Co alloys), and the like, or a resin belt may be used that is formed of a resin such as polyimide. In addition, the elastic layer may include silicone rubber, fluorine rubber, fluorosilicone rubber, or the like.

The radius of the fixing belt 38 is, for example, suitably about 20 mm to about 50 mm. A lubricant (such as silicone oil, for example) may be applied to the inner peripheral surface of the fixing belt 38 that has been formed with the plural DLC layer portions 64B (the sliding surface against the fixed sliding member 44).

Explanation will next be given of the pressure roll 40. An example is described below of the first exemplary embodiment in which the pressure roll 40 is separable from the fixing belt 38. However, the fixing belt 38 and the pressure roll 40 may be in constant contact. The pressure roll 40 is disposed, for example, with spring members (not shown) at each end thereof, so as to press the fixed sliding member 44, through the fixing belt 38 with a total load of equal to or about 294 N (equal to or about 30 kgf). However, upon pre-heating (heating up to the state in which fixing is possible) the pressure roll 40 is moved (not shown) so as to be separated from the fixing belt 38.

As the pressure roll 40, for example, a roll including a cylindrical core member 40A made of a metal and an elastic layer 40B (e.g., a silicone rubber layer, a fluororubber layer) provided on the surface of the core member 40A can be used. If necessary, the pressure roll 40 may have a surface release layer (e.g., a fluoroplastic layer) on the outermost surface thereof.

Explanation will next be given of the heat generation control member 46. The heat generation control member 46 is configured in a shape that is similar to the inner peripheral surface of the fixing belt 38, and is disposed so as to contact the inner peripheral surface of the fixing belt 38, and so as also to face the magnetic field generation device 42 with the fixing belt 38 therebetween.

Furthermore, the heat generation control member 46 is held, through spring members 48B of the support member 48, in a non-contact state to the support member body 48A and the heat generation control member 46 maintains the fixing belt 38 in a circular cylindrical shape while disposed in contact with the inner peripheral surface of the fixing belt 38 without applying thereto pressure. In the first exemplary embodiment the heat generation control member 46 contacts the inner peripheral surface of the fixing belt 38 with a force of equal to or about I N. There is no extreme distortion of the belt shape when the heat generation control member 46 contacts with the belt, since a tensional force is not applied to the belt.

The heat generation control member 46 may, for example, be composed of a temperature-sensitive magnetic metal material having a Curie point, and includes a non-heat generating body that does not generate heat by the action of a magnetic field thereon. The Curie point of the temperature-sensitive magnetic metal material is preferably in a range of a preset temperature of the fixing belt 38 to a heat-resistant temperature of the fixing belt 38. More specifically, the Curie point is preferably in a range of, for example, equal to or about 140° C. to equal to or about 240° C., more preferably in a range of equal to or about 150 to equal to or about 230° C.

Explanation will next be given of the fixed sliding member 44. The fixed sliding member 44 may, for example, be composed of a rod shaped member with an axial line along the axial direction (width direction) of the fixing belt 38, and is a member that resists the pressure acting from the pressure roll 40. The fixing belt 38 is deformed to the inner peripheral surface side thereof, by pressure from the pressure roll 40 pressing the fixed sliding member 44 through the fixing belt 38. In this manner, curvature is applied to the fixing belt 38 at the downstream side portion in the paper conveying direction of the contact portion between the pressure roll 40 and the fixed sliding member 44, and the paper is thereby separated from the fixing belt 38.

In order to obtain the above separating effect of the paper, the configuration of the fixing belt 38 is determined depending on whether the fixing belt 38 is able to elastically deform toward the inner peripheral side thereof by the pressing of the pressure roll 40 to the fixed sliding member 44 through the fixing belt 38. In the first exemplary embodiment a metal material is used for the fixing belt 38. Therefore the flexibility of the fixing belt is determined by the layer of the metal, which determines the rigidity of the fixing belt 38.

It may be examined by use of a non-magnetic stainless hard material whether or not the fixing belt 38 warps or bends toward the inside thereof inside its elastic deformation region. When a pressing force equal to or more than the load imposed onto the fixing belt at least at the time of the fixation of an image is given thereto, the warp amount thereof is evaluated. As a result, when the thickness of the hard material is 250 μm, the material hardly warps. When the thickness is 200 μm, the generation of a slight warp begins. When the thickness is 150 μm, 125 μm, 100 μm, and 75 μm, a sufficient warp is generated. Accordingly, the metal material layer of the fixing belt 38 is desirably 200 μm or less.

There are no particular limitations to the material of the fixed sliding member 44, as long as the warp amount is below a certain amount when the pressing force of the pressure roll 40 acts thereon. Silicone rubber, for example, may be appropriately used. Other than silicone rubber, heat resistant resins, such as aluminum or glass fiber reinforced PPS (polyphenylene sulfite), phenol, polyimide, or liquid crystal polymers, may be used.

Explanation will next be given of the support member 48. The support member 48 is, for example, configured with: a support member body 48A; spring members 48B for supporting the heat generation control member 46; and shafts 48C that are provided at both ends, in the length direction of the support member body 48A, of the support member body 48A.

The support member body 48A and the shafts 48C may, for example, be made from a metal material or from a resin material or the like, and the support member body 48A may be composed, for example, of a non-magnetic metal material (for example copper, aluminum or silver). If the warp due to the load on the shafts 48C is large and the shaft rigidity is a problem, then the shafts 48C may be constructed from a material having a Young's modulus such that the warp is small, together with a non-magnetic material.

The spring members 48B are connecting members between the heat generation control member 46 and the support member body 48A, and directly support the heat generation control member 46. The spring members 48B are connected to the heat generation control member 46 at both ends in the width direction of the heat generation control member 46.

The spring members 48B are, for example, configured as bent plate springs (made, for example, from a metal, or from various elastomers). The heat generation control member 46 is supported by these spring members 48B, and also follows displacement of the fixing belt 38, even if the fixing belt 38 rotates eccentrically and the fixing belt 38 is displaced in the radial direction thereof, so as to maintain a contact state with the inner peripheral surface of the fixing belt 38.

Explanation will next be given of the driving force transmission members 50. The driving force transmission members 50 are each a member for transmitting driving force for rotating the fixing belt 38 around its rotary center. The members 50 are each composed of, for example, a flange section 50A fitted to the inside of one of ends of the fixing belt 38 and a cylindrical gear section 50B having, in its outer peripheral surface, irregularities. The driving force transmission members 50 are composed of, for example, a metal material, a resin material, or the like.

The driving force transmission members 50 are disposed at the edge portions of the fixing belt 38 while the flange portions 50A of the driving force transmission members 50 are fitted inside each of the edges of the fixing belt 38. The gear portions 50B of the driving force transmission members 50 are rotationally driven by a motor or the like (not shown), and this rotational force is transmitted to the fixing belt 38, and the fixing belt 38 itself rotates.

The driving force transmission members 50 are fitted to both ends of the fixing belt 38 in its axial direction. However, the invention is not limited to this form. A driving force transmission member may be fitted only to one end of the fixing belt 38 in its axial direction. The driving force transmission members 50 are supported at the ends of the fixing belt 38 by fitting the flange sections 50A to the insides of the ends of the fixing belt 38. However, the invention is not limited to this form. The driving force transmission members 50 may be supported at the ends of the fixing belt 38 by fitting ends of the fixing belt 38 to the insides of the flange sections 50A.

Explanation will next be given of the magnetic field generation device 42. The magnetic field generation device 42 is formed to have a shape following the outer peripheral surface of the fixing belt 38. The magnetic field generation device 42 is arranged so as to face the heat generation control member 46 through the fixing belt 38 between the device 42 and the member 46, and separately from the outer peripheral surface of the fixing belt 38 to have an interval of, for example, equal to or about 1 mm to equal to or about 3 mm. In the magnetic field generation device 42, an exciting coil (magnetic field generation unit) 42A wound into plural circles is arranged along the axial direction of the fixing belt 38.

To this exciting coil 42A is connected an exciting circuit (not shown) for supplying an alternating current to the exciting coil 42A. Moreover, a magnetic substance member 42B is arranged to extend along the length direction of the exciting coil 42A (the axial direction of the fixing belt 38) on the surface of the coil 42A.

Due to the output of the magnetic field generation device 42, for example, a magnetic field (magnetic flux) passes through the heat generation layer of the fixing belt 38 and causes the heat generation layer to heat up.

It should be noted that the magnetic field generation device 42 may be provided at the inner peripheral surface side of the fixing belt 38 with a predetermined gap thereto. In such a case, the heat generation control member 46 is provided in contact with the outer peripheral surface of the fixing belt 38.

Explanation will now be given of the operation of the image forming apparatus 100 according to the first exemplary embodiment.

First, the surface of the photoreceptor drum 10 is charged by the charging device 12. Next, from the exposure device 14, the light L is imagewise radiated to the surface of the photoreceptor drum 10 so that a latent image is formed on the surface by a difference between electrostatic potentials on the surface. The photoreceptor drum 10 is rotated in the direction of the arrow A so that the latent image is transferred to a position opposite to one (the developer 16A) out of the developers of the developing device 16. A first color toner is then transferred from the developer 16A onto the latent image so that a toner image is formed on the surface of the photoreceptor drum 10. By the rotation of the photoreceptor drum 10 in the direction of the arrow A, this toner image is transported to a position opposite to the intermediate transferring member 18, and then the image is electrostatically transferred primarily onto the surface of the intermediate transferring member 18 by the transfer device 24.

Toner remaining on the surface of the photoreceptor drum 10 after primary transfer is removed by the cleaning device 20, and the surface of the cleaning device 20 after cleaning is initialized to the initial voltage by the charge removing light exposing device 22, and then the surface is moved to a position which again faces the charging device 12.

The three developers 16B, 16C and 16D of the developing device 16 then move so as to sequentially be positioned facing the photoreceptor drum 10. The toner images of the second color, third color and fourth color are formed in succession with the same method as used for the first color, and these toner images are each primary transferred onto the surface of the intermediate transfer member 18 so as to be superimposed as four colors.

The toner images that have been superimposed on top of each other on the intermediate transfer member 18 are moved by the rotational movement of the intermediate transfer member 18 in the direction of arrow B, and conveyed to the position between the transfer roll 30 and the transfer counter roll 28, and the toner images contact with the recording paper P that has been conveyed in. A transfer bias voltage is applied between the transfer roll 30 and the intermediate transfer member 18, and the toner images are secondary transferred onto the surface of the recording paper P.

The recording paper P holding the toner images, which have not yet been fixed, is carried via a paper guide member 36 to the fixing device 32.

The operation of the fixing device 32 according to the first exemplary embodiment will next be explained.

First, in the fixing device 32, for example, the toner image forming operation in the image forming apparatus 100 is initiated, and at the same time (there may, of course, be a time lag, and this also applies to other cases below), with the fixing belt 38 and the pressure roll 40 in a separated state, the driving force transmission members 50 are rotationally driven by a motor (not shown), and the fixing belt 38 is rotationally driven therewith in the direction of arrow D at, for example, a peripheral speed of equal to or about 200 mm/s.

Together with the rotational driving of the fixing belt 38, an alternating current is supplied from an excitation circuit (not shown) to an exciting coil 42A included in the magnetic field generation device 42. When the alternating current is supplied to the exciting coil 42A, magnetic flux (magnetic field) is repeatedly generated and extinguished in the periphery of the exciting coil 42A. When this magnetic flux (magnetic field) cuts across the heat generation layer of the fixing belt 38, an eddy current is generated in the heat generation layer, which generates a magnetic field that opposes the change in the initial magnetic field, and heat is generated in proportion to the surface resistance of the heat generation layer and the square of the current flowing in the heat generation layer.

The fixing belt 38 is thereby heated by the heat generation layer up to a predetermined temperature (150° C., for example) for equal to or about 10 seconds, for example.

Next, in a state in which the pressure roll 40 is pressed against the fixing belt 38, the recording paper P that has been conveyed into the fixing device is conveyed into the contact portion between the fixing belt 38 and the pressure roll 40, and the recording paper P pressed and heated by the fixing belt 38 that has been heated by the heat generation layer and the pressure roll 40, the toner image is fused and press-adhered to the surface of the recording paper P, and the toner image is fixed to the surface of the recording paper P.

The plural DLC layer portions 64B that are formed on the inner peripheral surface of the fixing belt 38 are of a material that is extremely hard and brittle. If the DLC layer was to be made in the manner of the continuous layer DLC layer 64A as shown in FIG. 4A, then when force is applied to the belt substrate 62, such as by the driving of the fixing belt 38 and the sliding movement against the fixed sliding member 44, then cracking and delamination of the DLC layer 64A would occur. As a result, a reduction in the abrasion resistance and ability to slide of the DLC occurs, with a reduction in reliability.

In contrast, by making the DLC layer 64 as a non-continuous layer (a layer formed from plural DLC layer portions 64B that have been formed to be separate from each other), concentrations of stress due to warping of the DLC may be prevented from occurring, and the occurrence of cracks and delamination in the DLC layer 64 may be suitably prevented.

Furthermore, the plural DLC layer portions 64B are separated from each other with the grooves 66 therebetween, and the grooves 66 are formed at an angle that is toward the belt axial direction central portion when facing from the downstream side back to the upstream side in the sliding direction (direction of arrow H) relative to the fixed sliding member 44. Therefore, a lubricant flows toward the belt axial direction central portion during sliding against the fixed sliding member 44, and uneven distribution of the lubricant toward the two edge portions, and leakage of the lubricant, may furthermore be suitably prevented, so that good sliding characteristics may be maintained over a prolonged period.

When fixing is carried out with the fixing belt 38 and the pressure roll 40, the fixing belt 38 is contacted without pressure to the heat generation control member 46 that has a shape that is similar to that of the inner peripheral surface of the fixing belt 38. Thereby: the fixing belt 38 rotates while being supported; a reduction in the sliding resistance is suppressed: vibrations of the fixing belt 38 due to the fixed sliding member 44 are suppressed, and electromagnetic force (the repulsion force between the magnetic field from the coil and the reaction magnetic field opposing the coil magnetic field formed by eddy currents flowing in the heat generation layer, that is to say the force acting on the belt from the coil in a direction to force them apart) is taken by the heat generation control member 46; and fixing takes place with a stable separation distance between the belt and the coil, with the belt shape maintained.

When the recording paper P is transferred from the contact portion between the fixing belt 38 and the pressure roll 40, the recording paper P attempts to carry straight on in the direction in which it has been conveyed out due to its rigidity, and the leading edge of the recording paper P is thereby separated from the curve of the rotating fixing belt 38. Then, the separating member 52 (separation sheet 52B) intrudes into the gap between the leading edge of the recording paper P and the fixing belt 38, and the recording paper P is separated from the fixing belt 38.

As described above, the toner image is formed on the recording paper P and then fixed thereon.

Furthermore, the first exemplary embodiment shows a belt on which the non-continuous DLC layer 64 is formed from the plural DLC layer portions 64B, which is used as the fixing belt, but there is no limitation thereto. The belt formed with the non-continuous DLC layer 64 may be used, for example, as an intermediate transfer belt, a recording medium conveying belt, or the like.

Second Exemplary Embodiment

An image forming apparatus according to a second exemplary embodiment of the invention is the same as the image forming apparatus according to the first exemplary embodiment except that it has a non-continuous DLC layer formed on a sliding surface of the fixed sliding member 44 in the fixing device 32, instead of having the plural DLC layer portions 64B formed on the surface of the belt substrate 62 of the fixing belt 38 as in the image forming apparatus according to the first exemplary embodiment. The term sliding surface refers here to a surface of the fixed sliding member 44 on/against which another member slides, and in the second exemplary embodiment refers to the surface of the fixed sliding member 44 on which the fixing belt 38 slides.

The same configuration as that in the image forming apparatus according to the first exemplary embodiment may be used, as it is, in the image forming apparatus according to the second exemplary embodiment, apart from the different characteristics mentioned above. Therefore, these characteristics will now be explained, and explanation of the rest of the configuration will be omitted.

Figure 6:
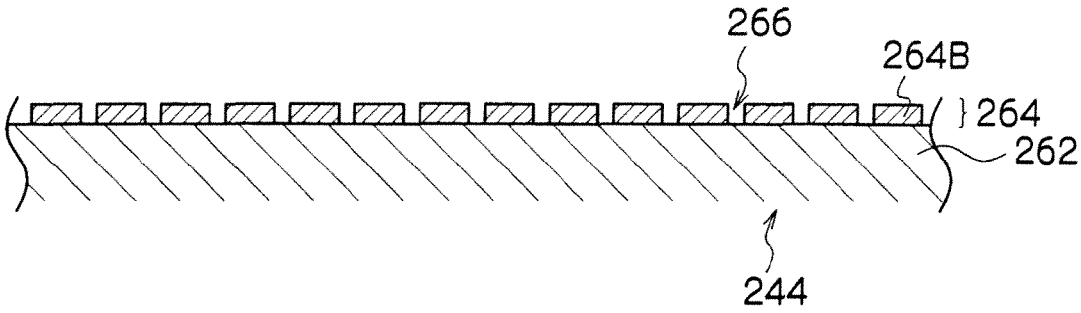
FIG. 6 is a schematic cross-section showing the surface of a fixed sliding member according to a second exemplary embodiment of the invention.

FIG. 6 is a schematic cross-section showing the surface (sliding surface) of a fixed sliding member according to the second exemplary embodiment In the image forming apparatus according to the second exemplary embodiment there is no non-continuous DLC layer 64 formed on the surface of the fixing belt 38, as described above, that is to say the belt substrate 62 alone configures the fixing belt 38. Furthermore, as shown in FIG. 6, in the fixed sliding member 244 of the second exemplary embodiment there is a non-continuous DLC layer 264 formed from plural DLC layer portions 264B on the surface (sliding surface) of a substrate 262. The plural DLC layer portions 264B are furthermore separated from each other by grooves 266, and the grooves 266, in the same manner as the grooves 66 of the first exemplary embodiment, are formed at an angle that is toward the belt axial direction central portion direction when facing in the sliding direction (the direction that the fixing belt 38 slides) from the upstream side toward the downstream side. The same materials may be used for the substrate 262 of the fixed sliding member 244 as are used in the fixed sliding member 44 of the first exemplary embodiment.

Forming the non-continuous DLC layer 264 on the surface (sliding surface) of the fixed sliding member 244 may be undertaken by the same methods as are used for forming the non-continuous DLC layer 64 in the first exemplary embodiment.

The DLC for forming the DLC layer portions 264B provided on the sliding surface of the fixed sliding member 244 is a material that is extremely hard and brittle, and conventionally there would be concern that cracking and delamination of a DLC layer might occur if force is applied to the substrate. However, in contrast, by using the configuration of the non-continuous DLC layer 264 formed from the plural DLC layer portions 264B that have been formed so as to be separate from each other, concentrations of stress due to warping of the DLC may be prevented from occurring, and the occurrence of cracks and delamination in the non-continuous DLC layer 264 (DLC layer portions 264B) may be suitably prevented.

Furthermore, the plural DLC layer portions 264B are separated from each other with the grooves 266 therebetween, and the grooves 266 are formed at an angle that is toward the belt axial direction central portion when facing in the sliding direction of the fixing belt 38 from the upstream side toward the downstream side. Therefore, a lubricant flows in the direction toward the belt axial direction central portion during the sliding of the fixing belt 38, and uneven distribution of the lubricant to the two edge portions, together with leaking of the lubricant, may furthermore be suitably prevented, and good sliding characteristics may be maintained over a long period of time.

Third Exemplary Embodiment

An image forming apparatus according to a third exemplary embodiment of the invention is the same as the image forming apparatus according to the second exemplary embodiment except that it has a characteristic surface shape of the substrate 262 of the fixed sliding member 244 and characteristic regions on which the plural DLC layer portions 264B are formed. However, other than these characteristics, the configuration of the image forming apparatus according to the second exemplary embodiment may be used as it is. Explanation will therefore be given of the above characteristics, with explanation of other parts of the configuration omitted.

Figure 7:
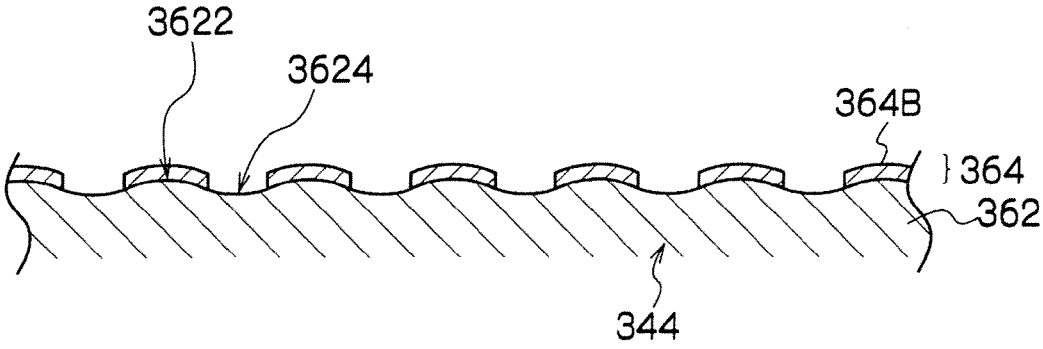
FIG. 7 is a schematic cross-section showing the surface of a fixed sliding member according to a third exemplary embodiment of the invention.

FIG. 7 is a schematic cross-section showing the surface of a fixed sliding member in the third exemplary embodiment.

A fixed sliding member 344 according to the third exemplary embodiment has a substrate 362 with an undulating surface (the inner peripheral surface) formed from protrusions 3622 and indentations 3624. Plural DLC layer portions 364B are formed to regions at least including the tops of the protrusions 3622.

The same methods may be used for forming the non-continuous DLC layer portions 364B to the regions including the tops of the protrusions 3622 on the surface of the substrate 362 as are used for forming the DLC layer portions 64B in the first exemplary embodiment.

The surface of the substrate 362 is undulated, and by forming the non-continuous DLC layer 364 to regions thereof including at least the tops, cracking and delamination may be suitably prevented from occurring in the non-continuous DLC layer 364 (DLC layer portions 364B), and good releasing characteristics may be obtained by a reduction in the contact surface area to the fixing belt 38.

It should be noted that while embodiments of the fixing device 32 are shown in the second and third embodiments in which the fixed sliding member 244 or the fixed sliding member 344 have been formed to have the non-continuous DLC layer 264 or the non-continuous DLC layer 364 thereon, the fixed sliding member of the invention is not limited to application thereto, and, for example, the fixed sliding member may be used for a photoreceptor cleaning blade or the like in an image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

EXAMPLES

Hereinafter, examples will be given of the image forming apparatuses according to the above exemplary embodiments of the invention.

Example 1

An image forming apparatus according to the second exemplary embodiment is prepared using the following components for the members used.

- Fixing belt 38: a belt formed with a belt substrate 62 (stainless steel (SUS)) having thereon a PFA outer peripheral surface layer (PFA: tetrafluoroethylene-perfluoroalkyl vinyl ether copolymer) (belt diameter: 35 mm)
- Pressure roll 40: a member in which a PFA layer is formed on the surface of an elastic layer (silicone sponge) (diameter: 35 mm)
- Fixed sliding member 244: a member in which non-continuous layer shaped plural DLC layer portions 264B are formed on a sliding surface of a substrate 262 (silicone rubber) (grooves 266 are formed at an angle that is toward the belt axial direction central portion when facing in the sliding direction of the fixing belt 38 from the upstream side toward the downstream side)

Comparative Example 1

An image forming apparatus is prepared that is of the same configuration as the image forming apparatus of Example 1, except that a fluororesin layer (continuous layer) is formed in place of the non-continuous DLC layer 264 of the fixed sliding member 244 of Example 1.

Comparative Example 2

An image forming apparatus is prepared that is of the same configuration as the image forming apparatus of Example 1, except that a continuous DLC layer is formed in place of the non-continuous DLC layer 264 of the fixed sliding member 244 of Example 1.

Evaluation

The image forming apparatuses of Example 1 and Comparative Examples 1 and 2 are driven, the change in the fixing belt driving torque with time is measured, and the abrasion of the fixed sliding member is observed.

Figure 8:
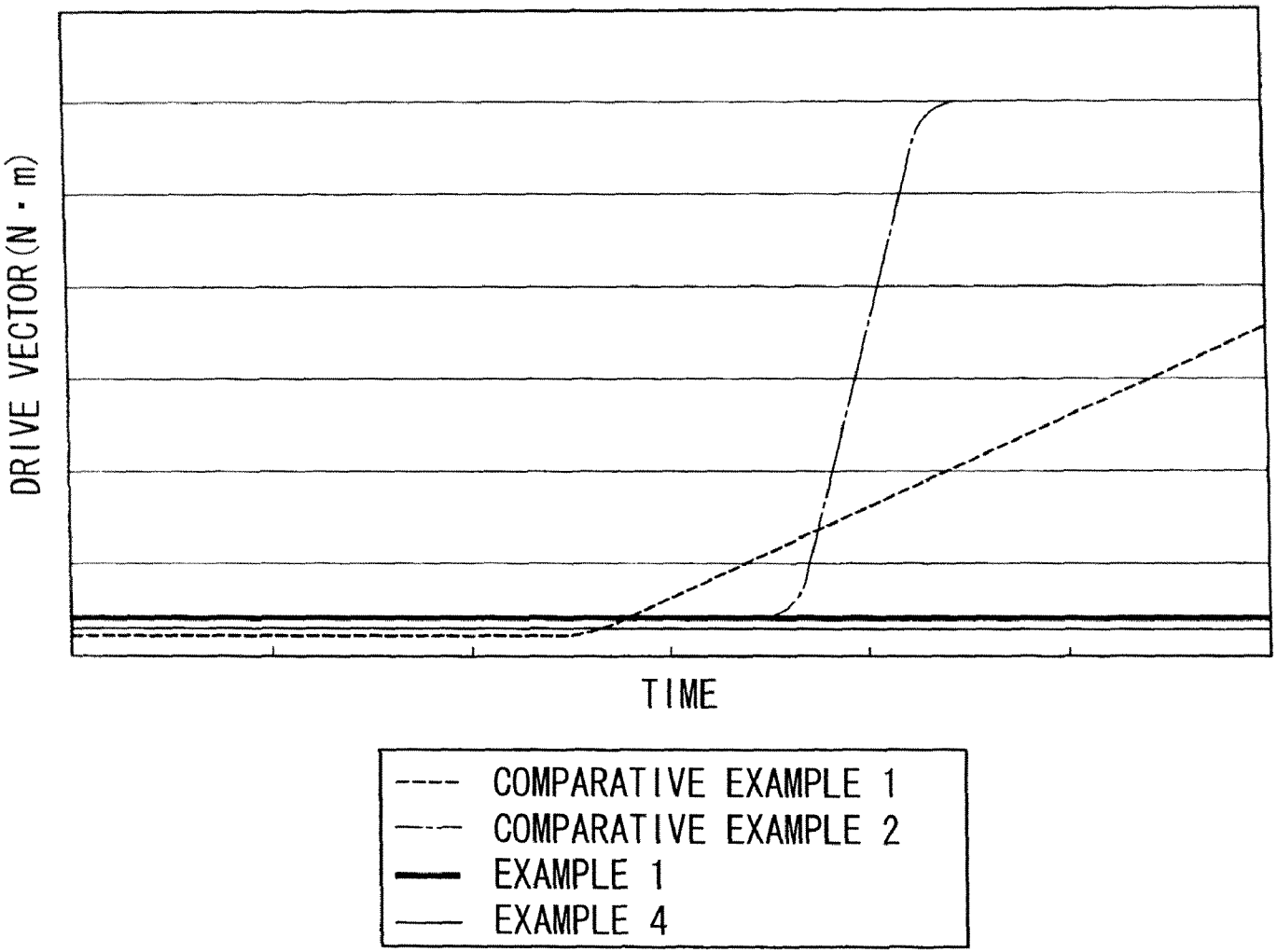
FIG. 8 is a graph showing the results of drive torque measurement in Examples of the invention.

As shown in FIG. 8, in the Comparative Example 1, the initial driving torque is good, but a reduction in the sliding properties occurs due to abrasion of the fluororesin layer, and the driving torque increases.

In the Comparative Example 2, initially good properties are maintained, but a reduction in the sliding properties occurs due to delamination of the continuous DLC layer, and the driving torque increases.

In the Example 1, there is no reduction in the sliding properties due to abrasion of the sliding member, and no delamination occurs, the sliding properties are maintained over a prolonged period of time and an increase in the driving torque is prevented.

Example 2

An image forming apparatus is prepared that is of the same configuration as the image forming apparatus of Example 1, except that 0.5 g of a lubricating oil is applied to the sliding surface (the inner peripheral surface of the fixing belt 38) of the fixing belt 38 against the fixed sliding member 244.

Example 3

An image forming apparatus is prepared that is of the same configuration as that of Example 2, except that the grooves 266 in the fixed sliding member 244 of Example 2 are formed in a lattice (that is, formed with grooves that are parallel to the belt axial direction and grooves that are parallel to the belt circumferential direction).

Evaluation

The image forming apparatuses of Examples 2 and 3 are driven, and any leakage of the lubricating oil is observed.

There is a small amount of leakage of the lubricating oil observed from the two edge portions of the fixing belt of Example 3. However, there is no leakage of the lubricating oil observed from the fixing belt of Example 2.

Example 4

An image forming apparatus according to the third exemplary embodiment is prepared using the following components for the members used.

Fixing belt 38: a belt formed with a belt substrate 62 (SUS) having thereon a PFA outer peripheral surface layer (belt diameter: 35 mm)

Pressure roll 40: a member in which a PFA layer is formed on the surface of an elastic member (silicone sponge) (diameter: 35 mm)

Fixed sliding member 244: a member in which a non-continuous layer shaped DLC layer 264 is formed on the sliding surface on a substrate 262 (silicone rubber) (the surface of the substrate 262 has undulations thereon, with the DLC layer portions 264B formed on regions including at least the tops of the undulations)

Evaluation

The change in the driving torque of the fixing belt with time is measured, and the abrasion of the fixed sliding member is observed in the same manner as in Example 1 and Comparative Examples 1 and 2. As shown in FIG. 8, in Example 4 there is no reduction in the sliding properties due to abrasion of the sliding member, and no delamination occurs, and the sliding properties are maintained over a prolonged period of time and an increase in the driving torque is prevented.

What is claimed is:

1. A sliding member, comprising:

a substrate; and a non-continuous diamond-like carbon layer provided on a surface of the substrate, the non-continuous diamond-like carbon layer being formed from a plurality of diamond-like carbon layer portions that are separated from one another by grooves extending along the axial direction of the sliding member and grooves formed at an angle that is toward the axial direction central portion when facing from the downstream side back toward the upstream side in the sliding direction of the sliding member, the length of each side of each of the plurality of diamond-like carbon layer portions being about 10 μm to about 3 mm.

2. The sliding member according to claim 1, wherein the surface of the substrate includes protrusions, and the plurality of the diamond-like carbon portions are formed to regions including at least the tops of the protrusions.

3. The sliding member according to claim 1, which is a belt for image formation or a fixed sliding member for an image forming apparatus.

4. The sliding member according to claim 1, wherein the width of each of the grooves is 1 μm to 100 μm.

5. The sliding member according to claim 1, wherein the thickness of the non-continuous diamond-like carbon layer is about 0.01 μm to about 5 μm.

6. A fixing device comprising:

a fixing belt;

a pressure member that contacts the outer peripheral surface of the fixing belt; and at least one fixed sliding member on which the fixing belt slides, the fixed sliding member contacting the inner peripheral surface of the fixing belt, at least one of the fixing belt and the fixed sliding member comprising a non-continuous diamond-like carbon layer on a sliding surface between the fixing belt and the fixed sliding member, the non-continuous diamond-like carbon layer being formed from a plurality of diamond-like carbon layer portions, when the plurality of the diamond-like carbon layer portions are formed on the sliding surface of the fixing belt, the plurality of diamond-like carbon layer portions being separated from one another by grooves extending along the belt axial direction and grooves formed at an angle that is toward the axial direction central portion when facing from the downstream side back toward the upstream side in the sliding direction of the fixing belt, when the plurality of the diamond-like carbon layer portions are formed on the fixed sliding member, the plurality of diamond-like carbon layer portions being separated from one another by grooves extending along the belt axial direction and grooves formed at an angle that is toward the belt axial direction central portion when facing from the upstream side toward the downstream side in the sliding direction of the fixing belt, the length of each side of each of the plurality of diamond-like carbon layer portions being about 10 μm to about 3 mm.

7. The fixing device according to claim 6, wherein the width of each of the grooves is about 1 μm to about 100 μm.

8. The fixing device according to claim 6, wherein the thickness of the non-continuous diamond-like carbon layer is about 0.01 μm to about 5 μm.

9. An image forming apparatus, comprising a sliding member including: a substrate; and a non-continuous diamond-like carbon layer provided on a surface of the substrate, the non-continuous diamond-like carbon layer being formed from a plurality of diamond-like carbon layer portions that are separated from one another by grooves extending along the axial direction of the sliding member and grooves formed at an angle that is toward the axial direction central portion when facing from the downstream side back toward the upstream side in the sliding direction of the sliding member, the length of each side of each of the plurality of diamond-like carbon layer portions being about 10 μm to about 3 mm.

10. The image forming apparatus according to claim 9, wherein the surface of the substrate of the sliding member includes protrusions, and the plurality of the diamond-like carbon portions are formed to regions including at least the tops of the protrusions.

11. The image forming apparatus according to claim 9, wherein the sliding member is a belt for image formation or a fixed sliding member for an image forming apparatus.

12. The image forming apparatus according to claim 9, wherein the width of each of the grooves is about 1 μm to about 100 μm.

13. The image forming apparatus according to claim 9, wherein the thickness of the non-continuous diamond-like carbon layer is about 0.01 μm to about 5 μm.

14. An image forming apparatus comprising a fixing device including:

a fixing belt;

a pressure member that contacts the outer peripheral surface of the fixing belt;

at least one fixed sliding member on which the fixing belt slides, the fixed sliding member contacting the inner peripheral surface of the fixing belt, at least one of the fixing belt and the fixed sliding member comprising a non-continuous diamond-like carbon layer on a sliding surface between the fixing belt and the fixed sliding member, the non-continuous diamond-like carbon layer being formed from a plurality of diamond-like carbon layer portions, when the plurality of the diamond-like carbon layer portions are formed on the sliding surface of the fixing belt, the plurality of diamond-like carbon layer portions being separated from one another by grooves extending along the belt axial direction and grooves formed at an angle that is toward the axial direction central portion when facing from the downstream side back toward the upstream side in the sliding direction of the fixing belt, when the plurality of the diamond-like carbon layer portions are formed on the fixed sliding member, the plurality of diamond-like carbon layer portions being separated from one another by grooves extending along the belt axial direction and grooves formed at an angle that is toward the belt axial direction central portion when facing from the upstream side toward the downstream side in the sliding direction of the fixing belt, the length of each side of each of the plurality of diamond-like carbon layer portions being about 10 μm to about 3 mm.

15. The image forming apparatus according to claim 14, wherein the width of each of the grooves is about 1 μm to about 100 μm.

16. The image forming apparatus according to claim 14, wherein the thickness of the non-continuous diamond-like carbon layer is about 0.01 μm to about 5 μm.

* * * * *